US005222331A

United States Patent [19]

Manor et al.

[11] Patent Number: 5,222,331

[45] Date of Patent: Jun. 29, 1993

[54] ABRADING ASSEMBLY

[75] Inventors: Edward L. Manor; Conrad T. Freerks, both of St. Paul, Minn.

[73] Assignee: Minnesota Mining and Manufacturing Company, St. Paul, Minn.

[21] Appl. No.: 507,394

[22] Filed: Apr. 10, 1990

[51] Int. Cl.[5] ..... B24D 15/04

[52] U.S. Cl. ..... 51/392; 51/388; 51/407

[58] Field of Search ..... 51/391, 392, 393, 407, 51/406, 394, 358, 388, 404

[56] References Cited

U.S. PATENT DOCUMENTS

| | | | |
|---|---|---|---|
| 391,581 | 10/1888 | Carver | 51/358 |
| 734,954 | 7/1903 | Reissmann | 51/384 |
| 1,599,906 | 9/1926 | McKnight | 51/371 |
| 1,710,308 | 4/1929 | Grifalconi | 51/384 |
| 1,782,577 | 11/1930 | Maris | 51/384 |
| 2,022,759 | 12/1935 | Delano et al. | 51/379 |
| 2,040,599 | 5/1936 | Davies | 51/391 |
| 2,115,943 | 5/1938 | Dempsey et al. | 51/358 |
| 2,256,098 | 9/1941 | Mauldin | 51/384 |
| 2,328,886 | 9/1943 | Andrews et al. | 51/392 |
| 2,493,852 | 1/1950 | Bonkowski | 51/372 |
| 2,495,370 | 1/1950 | Field | 51/391 |
| 2,644,280 | 7/1953 | O'Neil, Jr. | 51/406 |
| 2,724,936 | 11/1955 | Petrowsky | 51/385 |
| 3,089,294 | 5/1963 | Cowley | 51/392 |
| 3,699,672 | 10/1972 | Sims | 36/7.7 |
| 4,202,139 | 5/1980 | Hong et al. | 51/393 |
| 4,263,755 | 4/1981 | Globus | 51/358 |
| 5,036,627 | 8/1991 | Walters | 51/392 |

FOREIGN PATENT DOCUMENTS

| | | | |
|---|---|---|---|
| 0161695 | 7/1933 | Switzerland | 51/392 |

*Primary Examiner*—Robert A. Rose

*Attorney, Agent, or Firm*—Gary L. Griswold; Walter N. Kirn; William L. Huebsch

[57] ABSTRACT

An abrading assembly including a back up pad comprising a self supporting, resiliently flexible circular support layer and a flexible abrasive sheet. The abrasive sheet includes a circular central portion having a size generally corresponding to a front surface of the support layer, and at least two tab portions projecting from its central portion. The central portion of the sheet is adapted to overly the front surface of the support layer with the tab portions positioned along its peripheral surface, and means are provided for releasably attaching each of the tab portions to the back up pad. A user may insert his hand between a strap and rear surface of the support layer while the user moves his hand to move the abrasive sheet over a surface to be abraded.

6 Claims, 1 Drawing Sheet

ABRADING ASSEMBLY

TECHNICAL FIELD

The present invention relates to abrading assemblies comprising back up pads for supporting abrasive sheet materials, particularly including those assemblies intended to be used manually to abrade surfaces with the abrasive sheets.

BACKGROUND ART

In the late 1980's some car manufacturers started to use a new tough urethane based primer for their paint systems. Sanding this new primer with abrasive sheet material of the type comprising abrasive coated on a non porous flexible backing sheet (e.g., "Stick-it" gold coat abrasive sold by Minnesota Mining and Manufacturing Company, St. Paul, Minn.) caused excessive loading of the abrasive with removed primer thereby shortening abrasive life. An abrasive sheet material comprising porous screen cloth coated with abrasive and sold by Minnesota Mining and Manufacturing Company under the trade name "Wetordry Fabricut" abrasive has been found to work well to abrade the new urethane based primer without loading, and provides the further advantage that both major surfaces were coated with abrasive and can be used to thereby further extend its useful life. The abrasive coated screen cloth, however, can not be adhered to a back up pad with pressure sensitive adhesive which was commonly used to attach abrasive sheet material of the type comprising abrasive coated on a non porous backing sheet.

While the art describes many back up pads that employ many different attachment structures to attach an abrasive sheet along a support surface without the use of pressure sensitive adhesive (e.g., see U.S. Pat. Nos. 734,954; 1,559,906; 1,710,308; 1,782,577; 2,256,098; 2,493,852; 2,724,936 and 4,202,139), known back up pads are not suitable for manual use to press the abrasive coated screen cloth against the new urethane based primer on curved surfaces such as are commonly found on automobiles, and/or the means for attaching abrasive sheets to known back up pads requires that too large a portion of the abrasive be engaged and thus never used in the abrading process which is wasteful of the abrasive.

DISCLOSURE OF INVENTION

The present invention provides a back up pad that is suitable for use to press abrasive coated screen cloth against the new urethane based primer on curved surfaces such as are commonly found on automobiles, and provides means for attaching abrasive sheets to the back up pad that requires a very small portion of the abrasive be engaged to limit waste of the abrasive.

According to the present invention there is provided an abrading assembly including a back up pad comprising a self supporting, resiliently flexible circular support layer (e.g., a laminate comprising a central layer of a soft resiliently flexible polymeric foam, and outer resiliently flexible skin layers), and a flexible abrasive sheet. The abrasive sheet includes a circular central portion having a size generally corresponding to a front surface of the support layer, and at least two tab portions projecting from its central portion. The central portion of the sheet is adapted to overly the front surface of the support layer with the tab portions positioned along its peripheral surface, and means are provided for releasably attaching each of the tab portions to the back up pad.

While providing two tab portions on opposite sides of the circular central portion of the abrasive sheet is preferred, alternatively more tab portions (e.g., 3 or 4) could be around the periphery of its central portion. The use of two or four tab portions provides the advantage that the tab portions can be cut from what otherwise would be salvage when circular abrasive sheets are cut edge to edge from a large supply roll of abrasive material The tab portions are preferably rectangular projections from the circular central portion of the abrasive sheets, however other shapes such as truncated pyramidal shapes are also usable. The areas of the tab portions should be kept to a minimum to avoid edge cuts on a surface being abraded due to the bend in the abrasive sheet between the central portion and the tab portions of the abrasive sheet. The tab portions should represent less than 10 percent of the area of the abrasive sheet, and preferably should represent less than 5 percent of its area.

The back up pad has been particularly developed for use with the abrasive sheet material noted above comprising porous screen cloth coated with abrasive and sold by Minnesota Mining and Manufacturing Company under the trade name "Wetordry Fabricut" abrasive to abrade the new urethane based primer on automobiles. The back up pad is also useful, however, with other abrasive sheet materials including sheets of the lofty non woven abrasive coated material sold under the trademark "Scotchbrite", lapping film, or conventional abrasive sheet material comprising abrasive coated on a non porous flexible paper or cloth backing sheet.

The abrading assembly as illustrated herein is intended for manual use and includes means along a rear surface of the support layer (e.g., a resiliently elastic hand strap having ends attached to the support layer along its rear surface) adapted to be engaged by a user's hand to afford retaining the palm of the users hand along that rear surface while the user moves his hand to move the central portion of the abrasive sheet over a surface to be abraded. It is also contemplated, however, that some form of drive mechanism, such as a robot arm and/or a conventional rotary, oscillating and/or reciprocating drive mechanism could be attached to the back surface of the support layer to drive it, such as through the use of a hook and loop fastener.

Preferably, the means for releasably attaching each of the tab portions to the back up pad comprises a rigid attachment member including a first portion having a first inner surface adapted to project along the rear surface and a second portion having a second inner surface adapted to overlay the side of the tab portion opposite the peripheral surface of the support layer, a pointed projection projecting from the second inner surface adapted to pierce the tab portion and the support layer, and a resiliently elastic attachment strap having a first end attached to the first portion of the attachment member, and a second end attached to the support layer along the rear surface. The attachment strap has a length adapted to bias the projection along the second inner surface into engagement with the tab portion and the support layer, and is resiliently extensible to afford removal of the projection from the tab portion and the support layer to afford removal of the flexible abrasive sheet from the back up pad. Alternatively other means for releasably attaching each of the tab portions to the back up pad could be provided such as by providing hooks adapted to engage the tab portion instead of the attachment members at the ends of the elastic attachment straps, or by providing hook and loop fastener means with, for example, the hooks on the periphery of the support layer and the loops on the tab portions.

BRIEF DESCRIPTION OF THE INVENTION

The present invention will be further described with reference to the accompanying drawing wherein like reference numerals refer to like parts in the several views, and wherein.

DETAILED DESCRIPTION

Figure 1:
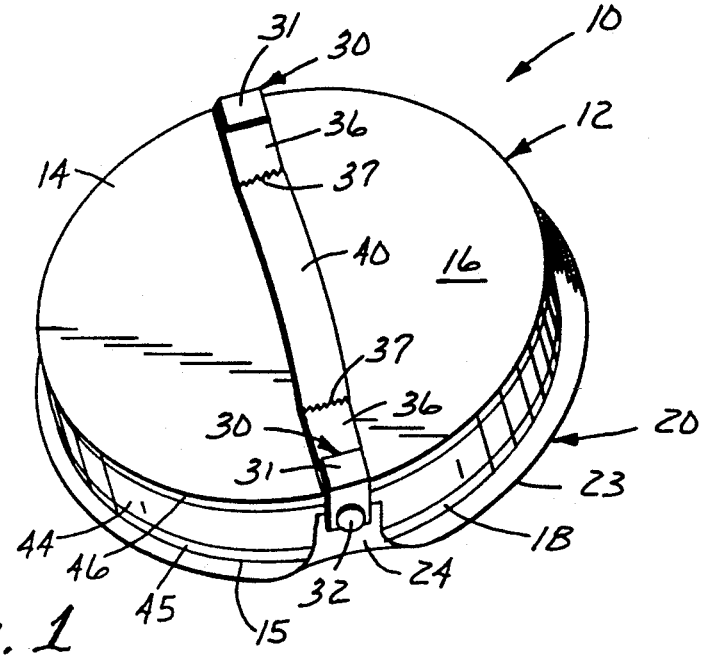
FIG. 1 is a perspective view of an abrading assembly according to the present invention.
Figure 3:
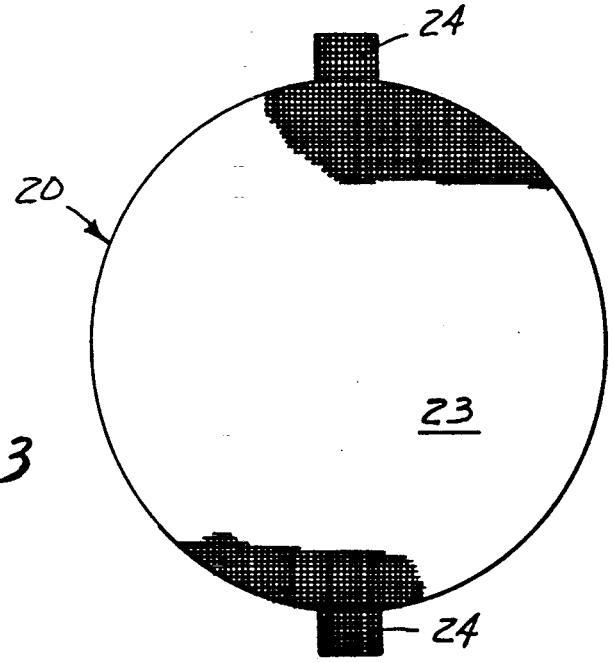
FIG. 3 is a plan view of a sheet of sheet of abrasive included in the abrading assembly of FIG. 1.
Figure 2:
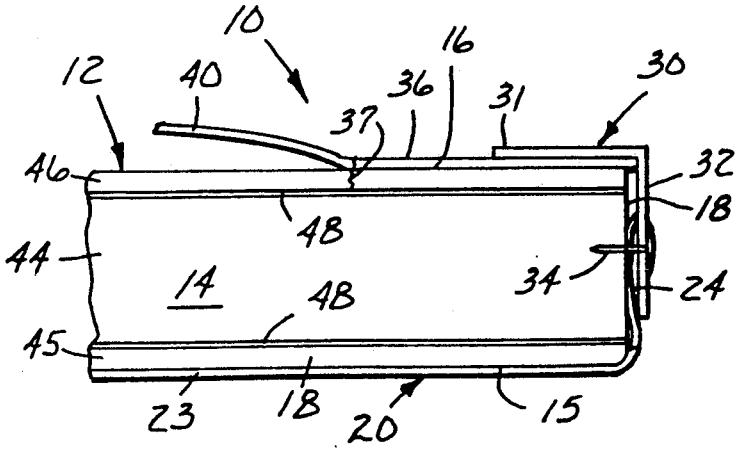
FIG. 2 is an enlarged fragmentary side view of the abrading assembly of FIG. 1.

Referring now to the drawing, there is shown an abrading assembly according to the present invention generally designated by the reference numeral 10.

Generally the abrading assembly 10 comprises a back up pad 12 comprising a self supporting, resiliently flexible circular support layer 14 having front and rear surfaces 15 and 16 and a peripheral edge surface 18 between its front and rear surfaces 15 and 16. The assembly also includes a flexible abrasive sheet 20 having abrasive material adhered thereto. The abrasive sheet 20 includes a circular central portion 23 having a size generally corresponding to the front surface 15 of the support layer 14, and at least two tab portions 24 projecting in circumferentially spaced relationship from its central portion 23. The central portion 23 of the abrasive sheet 20 is adapted to overlying the front surface 15 of the support layer 14 and the tab portions 24 are adapted to be positioned along the peripheral edge surface 18 of the support layer 14.

Means are provided for releasably attaching each of the tab portions 24 to the back up pad 12 including a rigid attachment member 30 including a first portion 31 having an inner surface adapted to project along the rear surface 16 of the support layer 14, and a second portion 32 having an inner surface adapted to overlay the side of the tab portion 24 opposite the peripheral surface 18 of the support layer 14. A pointed projection 34 (i.e., the pointed projection from a thumb tack pressed through the second portion 32) projects from the second inner surface and is adapted to pierce the tab portion 24 and the, support layer 14. A resiliently elastic attachment strap 36 has a first end attached to the first portion 31 of each of the attachment members 30, and a second end attached as by sewing stitches 37 to the support layer 14 along its rear surface 16. Each attachment strap 36 is attached in a position so that it extends radially of the support layer 14 and has a length adapted to bias the projection 34 on the second portion 32 into engagement with the tab portion 24 and the support layer 14, and is resiliently stretchable to afford removal of the projection 34 from the tab portion 24 and the support layer 14 to afford removal of the flexible abrasive sheet 20 from the back u 12.

The abrading assembly 10 further a resiliently elastic hand strap 40 having en attached as by the sewing stitches 37 to the support 14 along its rear surface 16 and extending diametrical the support layer 14 between the attachment straps 36 1 the rear surface 16 of the support layer 14. The 40 provides means along the rear surface 16 of the support layer 14 adapted to be engaged by a user's hand (e.g., by inserting a users hand between the strap and rear surface 16) to afford retaining the palm of the users hand along the rear surface 16 while the user moves his hand to move the central portion 23 of the abrasive sheet 20 over a surface to be abraded. The hand strap 40 and attachment straps 36 as illustrated may be provided by different portions of a single length of elastic strapping material, could alternatively be provided by discreet lengths of strapping material.

The support layer 14 is a laminate comprising a central layer 44 of resiliently flexible polymeric foam, and resiliently flexible outer layers 45 and 46 defining the front and rear surfaces 15 and 16 respectively, which outer layers 45 and 46 are also of a strongpolymeric foam and are adheared to the central layer by stretchy layers 48 of adhesive.

As a preferred example, the layer 14 can be 19.37 centimeters (7.63 inches) in diameter, the central layer 44 can be a 0.79 centimeter (0.3 inch thick layer of a skinless soft closed cell neoprene foam having a density of 12 to 20 pounds per cubic foot, a durometer from 40 to 60 on the Shore 00 scale, a tensile strength of 85 pounds per square inch, and an elongation of 200%; the outer layer 45 can be a 0.32 centimeter (0.125 inch) thick layer of a strong stretchy closed cell neoprene foam having a density of 15 to 30 pounds per cubic foot, a durometer of from 35 to 60 on the Shore 00 scale, a tensile strength of 100 pounds per square inch, and an elongation of 200% and which has no skin so that the front surface 15 is porous and thus makes good frictional engagement with the abrasive sheet 20 to drive it with the support layer 14 along a surface to be abraded while not being abraded by the abrasive sheet 20; and the outer layer 46 can be a 0.32 centimeter (0.125 inch) thick strong stretchy layer of a closed cell neoprene foam having a density of 10 to 16 pounds per cubic foot, a durometer of from 25 to 45 on the Shore 00 scale, a tensile strength of 50 pounds per square inch, and an elongation of 150% and which has a skin defining the rear surface 16 for comfortable no slip engagement by a users hand. Alternatively, the central layer 44 can be 1.9 centimeter or 0.75 inch thick layer of a four pound open cell polyester foam used with the same outer layers 45 and 46 described in the preceding example to provide a softer back up pad that may be preferred by some users for some uses.

As an illustrative example for use on the 19.37 centimeter or 7.63 inch diameter support layer 14 described in the preceding paragraph, an abrasive sheet 20 with a central portion 23 that is 20.3 centimeters or 8 inches in diameter of "Wetordry Fabricut" grade P800 aluminum oxide abrasive having rectangular tabs projecting about 1.3 centimeters or 0.5 inch from the central portion and being about 2.5 or 1 inch wide has been found to be firmly anchored on the support layer 14 when the abrading assembly is used to manually abrade the new tough urethane based primer on an auto body. Such tabs represent less than 2 percent of the area of the abrasive sheet 20.

The present invention has now been described with reference to one embodiment thereof. It will be apparent to those skilled in the art that many changes can be made in the embodiment described without departing from the scope of the present invention. Thus the scope of the present invention should not be limited to the structure described in detail in this application, but only by structures described by the language to the claims and the equivalents of those structures.

We claim:

1. An abrading assembly comprising:

a back up pad comprising a self supporting, resiliently flexible circular support layer having front and rear surfaces and a peripheral edge surface between said front and rear surfaces;

a flexible abrasive sheet comprising abrasive material, said abrasive sheet including a circular central portion having a size generally corresponding to the front surface of said support layer, and at least two tab portions projecting from said central portion in circumferentially spaced relationship, said central portion overlying the front surface and said tab portions being positioned along the peripheral surface of said support layer; and means for releasably attaching each of said tab portions to said back up pad comprising;

a rigid attachment member including a first portion having a first inner surface adapted to project along said rear surface and a second portion having a second inner surface adapted to overlay the side of said tab portion opposite the peripheral surface of said support layer, a pointed projection projecting from said second inner surface adapted to pierce said tab portion and said support layer, and a resiliently elastic attachment strap having a first end attached to the first portion of said attachment member, and a second end attached to said support layer along said rear surface, said attachment strap having a length adapted to bias said projection along said second inner surface into engagement with said tab portion and said support layer, and being resiliently extensible to afford removal of said projection from said tab portion and said support layer to afford removal of said flexible abrasive sheet from said back up pad.

2. An abrading assembly according to claim 1 wherein said flexible abrasive sheet has two tab portions projecting from opposite sides of said central portion, and said assembly further includes a resiliently elastic hand strap having ends attached to said support layer along said rear surface and extending between said attachment straps along said rear surface of said support layer, said hand strap being adapted to be engaged by a user's hand to afford retaining the palm of the users hand along said rear surface while the user moves his hand to move the central portion of the abrasive sheet over a surface to be abraded.

3. An abrading assembly according to claim 1 wherein said support layer is a laminate comprising a central layer of resiliently flexible polymeric foam, and outer resiliently flexible skin layers defining said front and rear surfaces.

4. An abrading assembly according to claim 1 wherein said tab portions represent less than 10 percent of the area of the abrasive sheet.

5. An abrading assembly according to claim 1 wherein said tab portions are rectangular and represent less than 5 percent of the area of the abrasive sheet.

6. An abrading assembly according to claim 1 wherein said tab portions are rectangular and represent less than 2 percent of the area of the abrasive sheet.

* * * * *